US006591431B2

(12) United States Patent
Hautmann et al.

(10) Patent No.: US 6,591,431 B2
(45) Date of Patent: Jul. 15, 2003

(54) DEVICE TO DISPENSE ACTIVE SUBSTANCES INTO RINSE WATER, ESPECIALLY IN TOILET BOWLS

(75) Inventors: Horst Hautmann, Neuburg/Donau (DE); Heinz-Dieter Schönbeck, Taunusstein (DE); Kurt Wagner, Ingolstadt (DE)

(73) Assignee: Jeyes Deutschland GmbH, Neuburg (DE)

( * ) Notice: Subject to any disclaimer, the term of this patent is extended or adjusted under 35 U.S.C. 154(b) by 0 days.

(21) Appl. No.: 10/138,324

(22) Filed: May 6, 2002

(65) Prior Publication Data

US 2003/0070213 A1 Apr. 17, 2003

Related U.S. Application Data

(62) Division of application No. 09/583,948, filed on May 31, 2000.

(51) Int. Cl.[7] ..... E03D 9/02
(52) U.S. Cl. ..... 4/231; 004/222; 004/223
(58) Field of Search ..... 4/231, 223, 227.1, 4/227.4, 227.5, 227.6, 224, 222; 222/156, 157

(56) References Cited

U.S. PATENT DOCUMENTS

| | | | | |
|---|---|---|---|---|
| 3,946,488 A | | 3/1976 | Sioufy | |
| 6,178,564 B1 | | 1/2001 | Leonard et al. | |
| 6,230,334 B1 | * | 5/2001 | Camp et al. | 4/231 |
| 6,389,610 B1 | * | 5/2002 | Hautmann et al. | 4/222 |
| 6,412,120 B1 | * | 7/2002 | Leonard et al. | 4/222 |

FOREIGN PATENT DOCUMENTS

| | | | |
|---|---|---|---|
| EP | 0 538 957 A1 | | 4/1993 |
| EP | 0 785 315 A1 | | 7/1997 |
| EP | 0 878 586 A2 | | 11/1998 |
| EP | 0878586 A2 | * | 11/1998 |
| WO | WO 98/09027 | | 3/1998 |
| WO | WO 98/090227 | | 3/1998 |
| WO | WO 99/66140 | | 12/1999 |

* cited by examiner

*Primary Examiner*—Robert M. Petsuba
*Assistant Examiner*—Khoa D. Huynh
(74) *Attorney, Agent, or Firm*—Sughrue Mion, PLLC

(57) ABSTRACT

A device to dispense active substances into rinse water, especially in toilet bowls, with a container for the active substance, wherein the container has an opening that connects with an essentially plate-shaped distributor, and with a device to hold the distributor on or close to the toilet bowl wall. The distributor consists of two essentially plate-shaped elements. There are intersecting grooves, channels or the like between the plate-shaped elements, and a first group of grooves runs outward from the distributor while the other second group of grooves only runs within the distributor.

16 Claims, 5 Drawing Sheets

Figure 1:
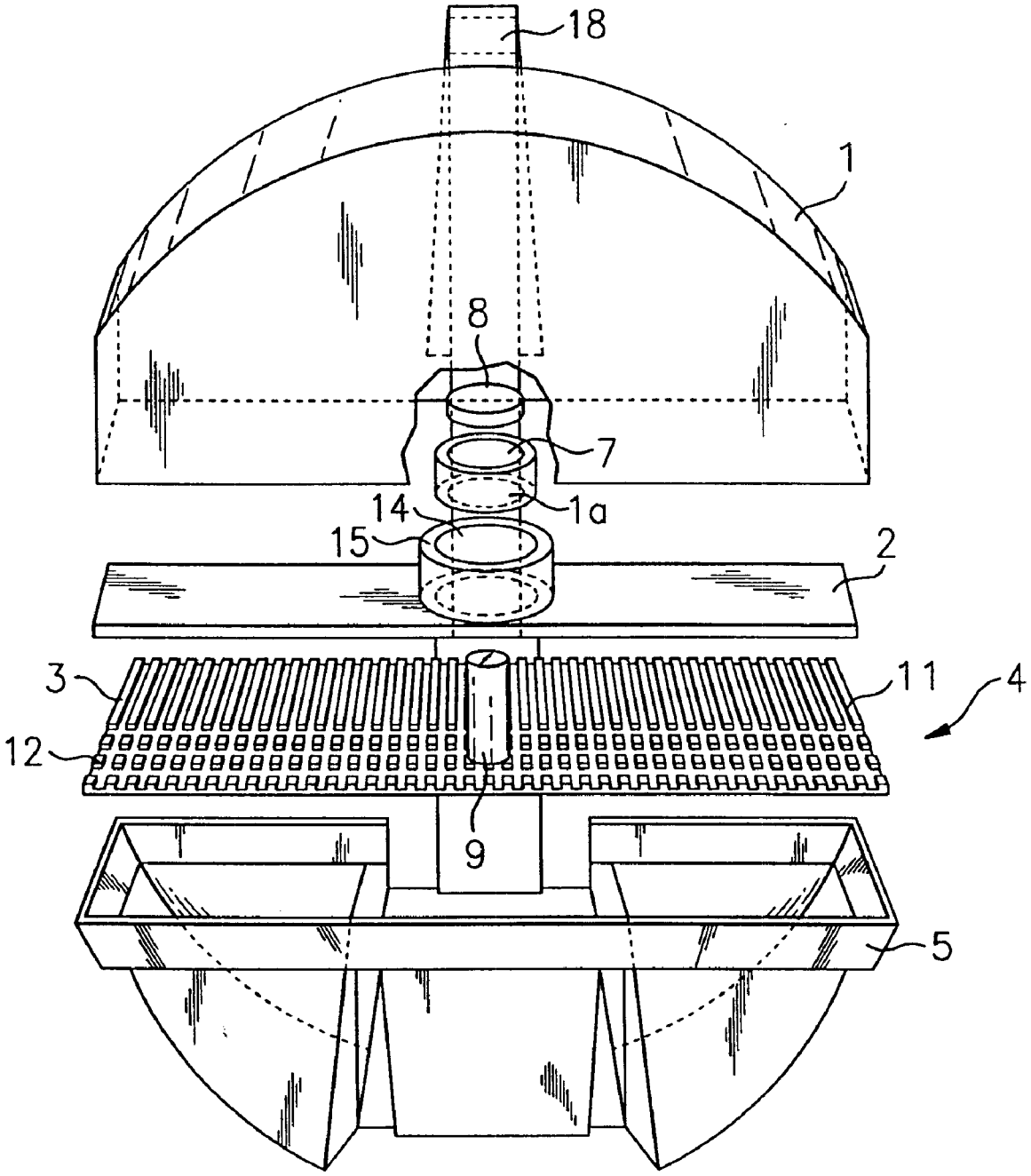

DEVICE TO DISPENSE ACTIVE SUBSTANCES INTO RINSE WATER, ESPECIALLY IN TOILET BOWLS

This is a divisional of application Ser No. 09/583,948 filed May 31, 2000; the disclosure of which is incorporated herein by reference.

The invention concerns a device to dispense active substances into rinse water, especially in a toilet bowl, according to the preamble of patent claim 1.

EP 0 53 89 57 B1 describes a device of the kind cited above and refers to a container with its opening facing downward that holds a liquid-permeable seal in the container opening to control the release of the active substance to a porous body below. Such a device allows the release or dosing of the active substance through the liquid-permeable seal in the container opening. The porous body absorbs the released active substance and retains it after a flush, and the active substance is released to the surrounding air. With this device, the active substance is dosed only through the liquid-permeable seal in the container opening. The comparatively expensive porous body is disadvantageous along with the fact that the porous body itself cannot be used to control or distribute the active substance into the toilet bowl. The liquid-permeable seal must therefore be provided as an additional element.

DE 197 20 393 A1 describes a device to release active substances in which the active ingredient container with its opening facing downward releases the active ingredient by dripping. Somewhat undesirable traces are left in the toilet bowl where the active substance contacts it. To counteract this disadvantage, an intermediate support is provided for the prior-art device that extends into the downward path of the active ingredient and releases the active ingredient together with the rinse water into the toilet bowl and thus avoids the cited traces of active ingredient.

The invention is therefore based on the problem of improving a device of the initially-cited kind so that the release of the active substance is controlled exclusively by the distributor, and the device has a simple and economical design.

This problem is solved according to the invention by the features of patent claim 1.

Other embodiments of the device according to the invention are found in the subclaims.

The invention provides a device to dispense an active substance into the rinse water of a toilet bowl, and especially a dispenser where a liquid active ingredient in a container is released during the flush to the rinse water and also remains on a provided distributor surface after the flush to freshen the air in the area of the toilet bowl.

The distributor provided in the invention is essentially defined by intersecting grooves. A first group of grooves releases the preferably liquid active substance outward from the distributor toward the toilet bowl, and a second group of grooves distributes the liquid active substance within the distributor. The second group of grooves preferably has a larger open cross-section and appropriately distributes the active substance within the distributor to the grooves that lead outward.

These grooves or channels are preferably parallel in each group. The grooves of the two groups intersect in the distributor to specifically and satisfactorily distribute the active ingredient outward.

The two groups of grooves act like capillary tubes, i.e., the liquid active ingredient is drawn from the outside via the first groove group either by the rinse water running inside the toilet bowl over the distributor, or by the independent evaporation of the liquid active substance between the individual flushes. A corresponding design of the cross-section of the individual grooves allows the liquid active substance to be correspondingly specifically dosed or dispensed into the toilet bowl both during and between the flushes.

Figure 2:
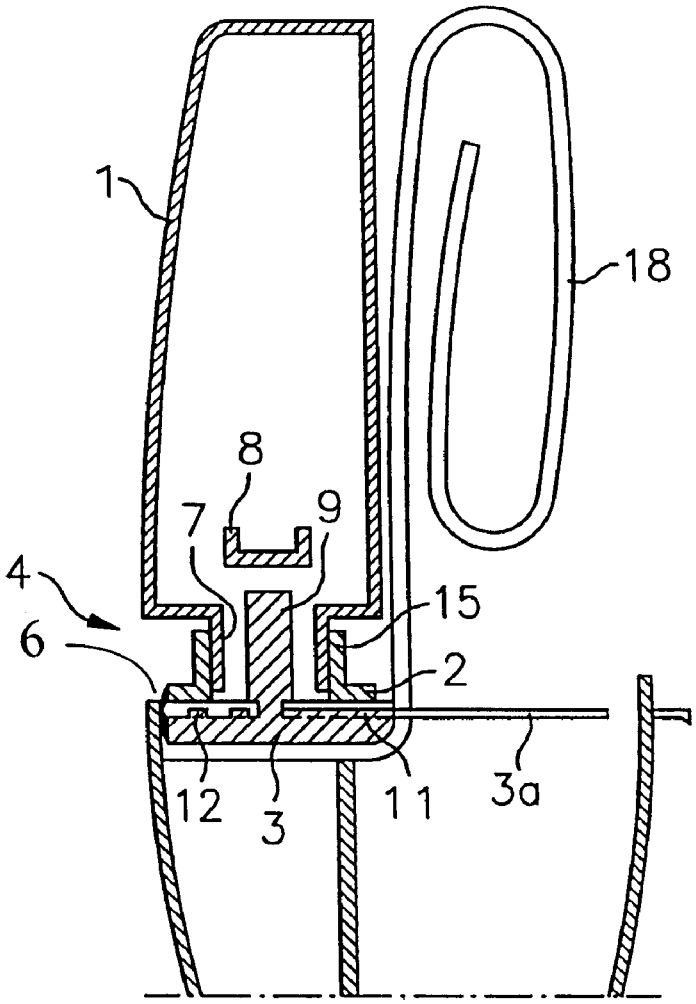
Figure 4:
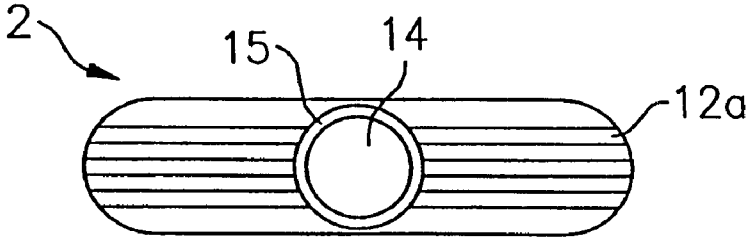
Figure 3:
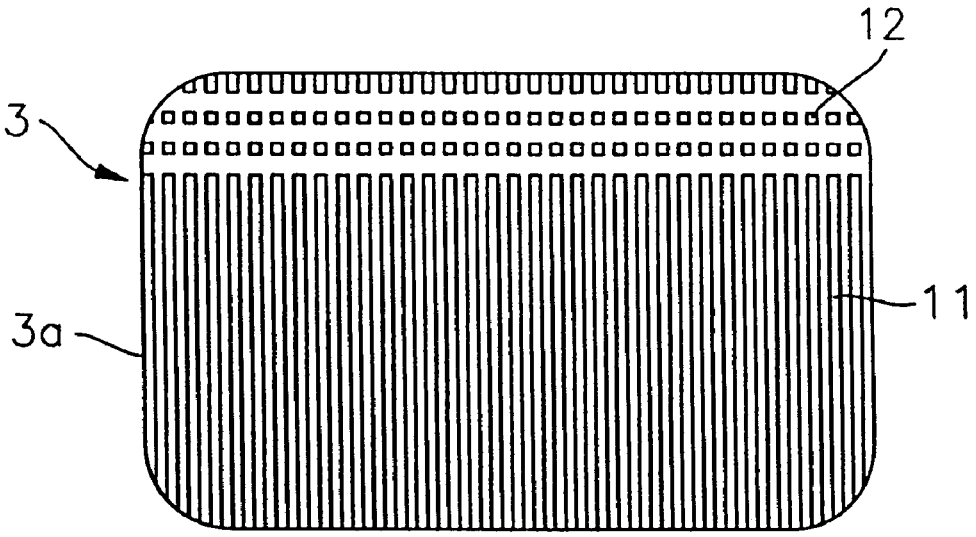
Figure 6:
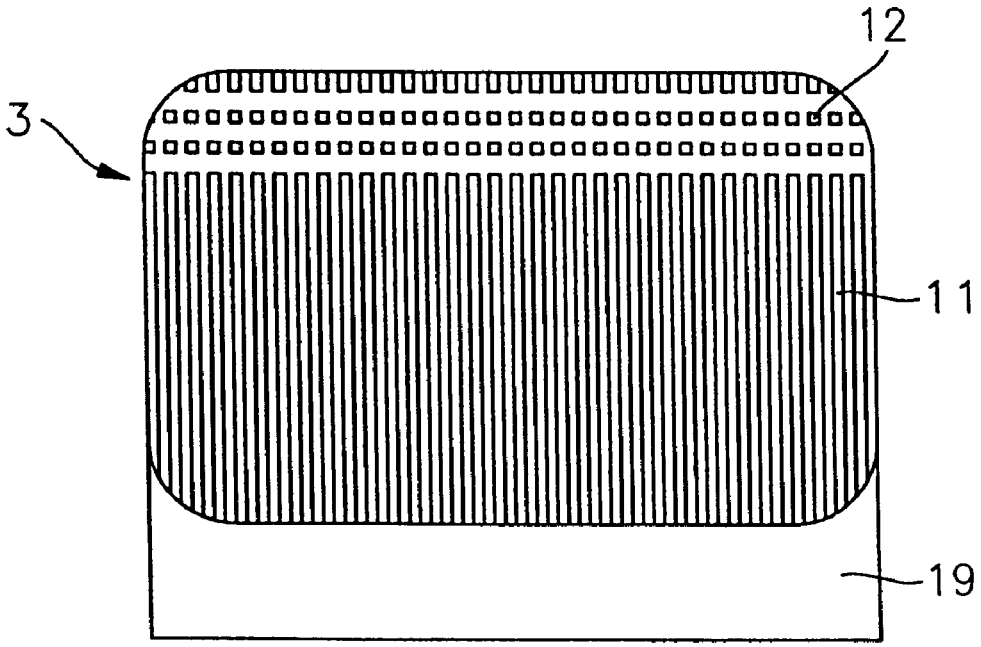
Figure 5:
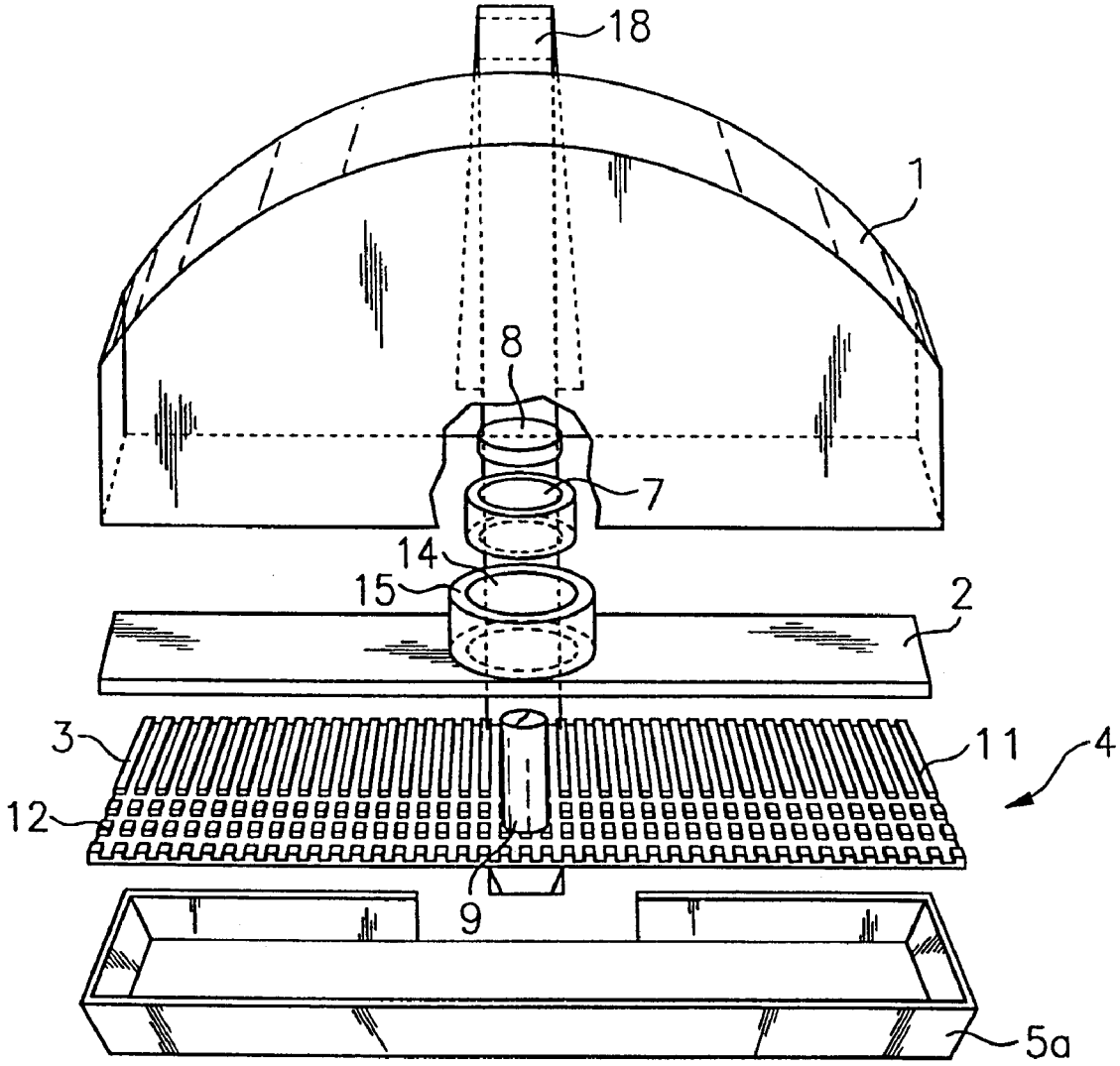

In the following, preferred embodiments of the device according to the invention will be described with reference to drawings to clarify additional features, in which:

FIG. 1 shows an exploded view of the device according to the invention,

FIG. 2 shows a partial section of the device according to the invention viewed from the side, and FIG. 3 shows a top view of a preferred embodiment of a part of the distributor, FIG. 4 shows a view of another part of the distributor from below, FIG. 5 shows an embodiment of the device according to the invention altered from FIG. 1, and FIG. 6 shows another embodiment of the plate-shaped element of the distributor.

Figure 7:
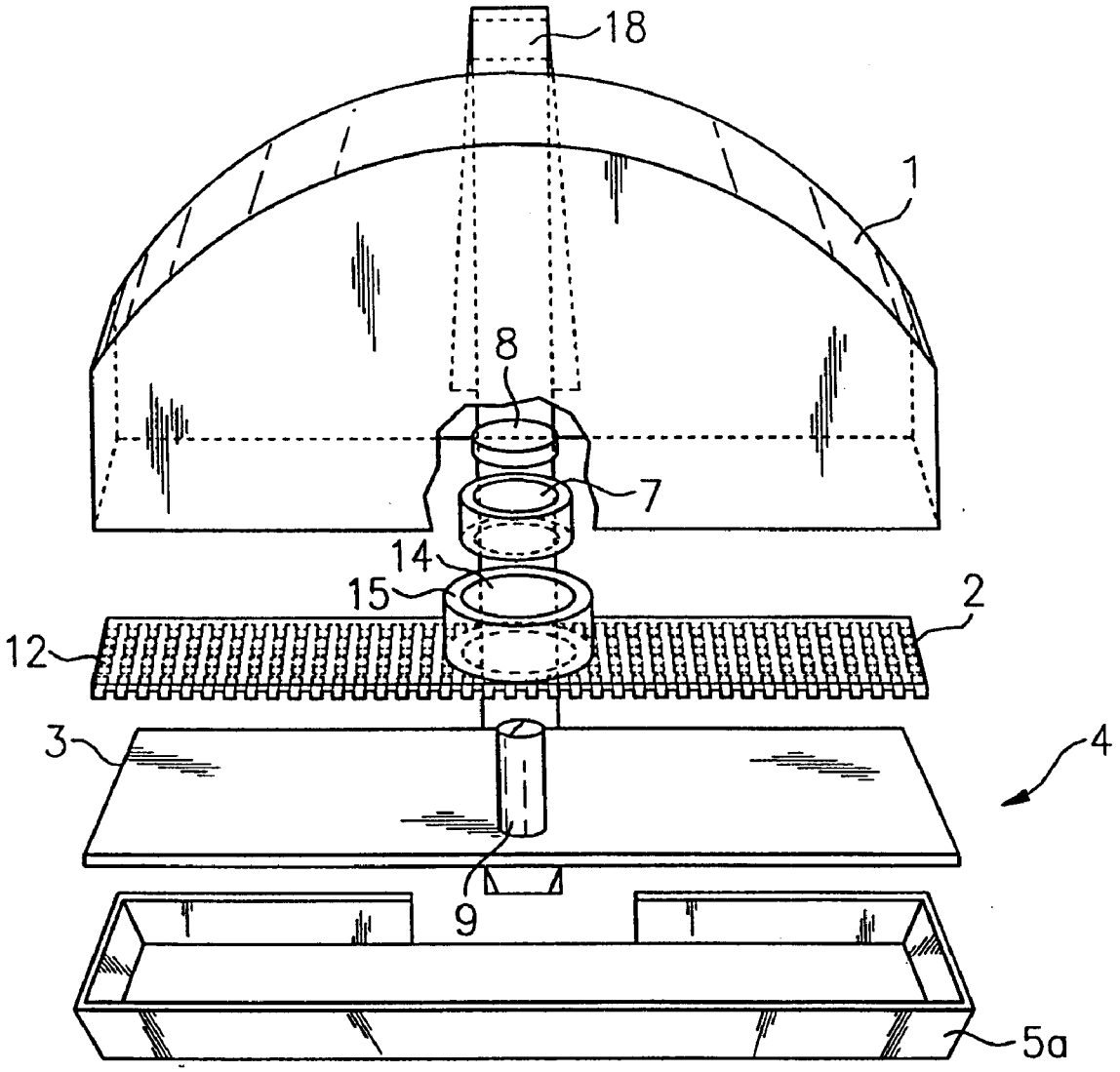

FIG. 7 shows an illustration of a structure where the grooves of the first and second groups are formed on the bottom surface of the second plate-shaped element.

The device according to the invention to dispense active substances is shown in FIG. 1 in an exploded view and consists of a container 1 preferably consisting of a translucent plastic in any desired form, a distributor 4 composed of two essentially plate-shaped elements 2,3, and possibly a frame 5 especially to receive the distributor 4.

The container 1 is provided with an opening 7 in its bottom side in FIG. 1. Before use, the opening 7 of the container 1 is sealed from the inside by a membrane 8 or the like to prevent the liquid active substance of the container 1 from leaving. By placing the container 1 on the device in the manner described later, the membrane 8 or the like is opened by a spike 9 or the like.

The distributor for releasing the active substance of the device according to the invention has a construction that essentially consists of plate-shaped elements 2,3, whereby each element 2,3 preferably consists of plastic and is provided with set grooves, channels or the like.

In a preferred embodiment, the distributor consists of a first bottom plate 3 and a second upper plate 2 on top.

According to the invention, there is a structure defined by grooves, channels or the like between the two plate-shaped elements 2,3 preferably made of plastic so that, when the container 1 is open, the liquid active substance can be dispensed from the container 1 via the grooves, channels or the like through the distributor 4 into the toilet bowl or rinse water.

In principle, it is only essential for the grooves to be located between the two plate-shaped elements 2,3; the grooves can be in the bottom of element 2 or in the top of element 3, or both in the bottom of element 2 and top of element 3. In the latter case, the groove sections assigned to each other can communicate with each other, i.e., coincide.

In the embodiment in FIG. 1, the first group of grooves or channels 11 runs perpendicular to the lengthwise axis of the plate-shaped element 3. The grooves 11 are preferably equally spaced as can be seen in FIG. 3 and preferably run the entire length and width of element 3, although this is not absolutely necessary. The second group of grooves 12 extends parallel to the lengthwise axis and is laterally offset from the midaxis, i.e., along the area that is covered by element 2. The number of grooves 12 of the second group is preferably 3 but can be greater or less as needed.

The grooves 12 of the second group preferably have a greater open cross-section in contrast to the perpendicular grooves 11 whose cross-section is shown to provide a full distribution of the liquid active ingredient over the entire length of the element 3 so that all the grooves 11 running perpendicular to this can be sufficiently supplied with liquid active substance.

As can be seen in FIGS. 1 and 3, the element 3 is essentially rectangular. The plate-shaped element 2 on element 3 also has an essentially rectangular shape and can be provided with additional grooves 12*a* as in FIG. 4 that coincide with the grooves 12 of element 3 to enlarge the open cross-section of the formed grooves of the second group in the area where elements 2,3 coincide.

For filling the distributor 4, the top element 2 is provided with an opening 14, around which a flange-like projection 15 can be provided, to receive the neck 1*a* of the container 1.

As shown in FIGS. 1 and 2 in particular, element 2 sits on element 3. Element 2 is on the side of element 3 to cover or enclose the grooves 12 while the plate-shaped element 3 extends over the side beyond plate shaped element 2. The grooves 11 in the remaining free surface of the plate-shaped element 3 serve to guide the liquid active substance that flows from the container 1 through opening 7, through opening 14 of element 2, into the connecting channel formed by the grooves 12, and outward via grooves 11 either during a flush in the toilet bowl or between flushes to act as an air freshener.

From the above description, we can see that there are intersections between the grooves 12 of the second group and grooves 11 of the first group to guide the liquid active ingredient that enters through opening 14 into the distributor 4 via channels 12 into channels 11.

When the plate-shaped element 3 is covered by the plate-shaped element 2, the grooves 11 and 12 are enclosed, i.e., they form channels or capillary-like tubes, while the grooves 11 that are outside of the plate-shaped elements 2 are open at the top and are hence accessible to the rising rinse water.

The cross-section of the grooves 11, 12, 12*a* can be a V, U, etc. The open cross-section of the grooves 11 is selected so that the active ingredient in the container 1 is dosed from the distributor 4 toward the plate-shaped element 3 that is directly accessible to the rinse water.

FIG. 4 shows a view of the plate-like element 2 from below. In FIG. 4 we can see that the plate-like element 2 can have grooves 12*a* that also run in a lengthwise direction on its bottom that coincide with the corresponding grooves 12 on the top of the bottom plate-shaped element 3. This substantially enlarges the open cross-section of the combined groove sections 12, 12*a*. Alternately, the grooves 12 can be formed just by the grooves 12*a* on the bottom surface of the plate-shaped element 2, and the corresponding grooves 12 in the surface of the plate shaped element 3 are dispensed with. In this case, the grooves 12*a* connect to channel liquid with the grooves 11 perpendicular to element 3 to draw active substance from the container 1 via the distributor 4 in the direction of the plate section 3*a*.

From the partial section in FIG. 2, we can see that after the container 1 is put on, the seal 8, e.g. in the form of a membrane or a plug, is pressed by the spike 9 out of the neck-shaped opening 7 of the container into the container. The neck 1*a* of the container 1 is then in the opening flange 15 in FIG. 2 that can be designed as a circular collar on the plate-shaped element 2. The section of the plate-shaped element 3 extending away on the side from the plate-shaped element 2 is designated by 3*a* in FIG. 2. When the device according to the invention is placed on the edge of a toilet bowl from the inside, the plate section 3*a* is close and approximately perpendicular to the essentially vertical wall of the toilet bowl and is therefore contacted by the rinse water during each flush.

FIG. 5 shows an embodiment altered from FIGS. 1 and 2. In FIG. 5, the parts that are the same as in FIGS. 1 and 2 have the same reference numbers and will therefore not be described. In contrast to the embodiment in FIGS. 1 and 2, the pot-shaped frame 5 on the bottom of the device according to the invention in the first embodiment is dispensed with. In the embodiment in FIGS. 1 and 2, it has a hook-like holder 18 that is provided in a manner known per se for such devices to clamp the device to the edge of a toilet bowl or the like. Correspondingly, the holder 18 is to be placed on the distributor 4 or on another site. In this embodiment, only a frame-like essentially flat and rectangular frame 5*a* is provided to reduce the overall height of the device. The frame 5*a* merely serves as a base for the plate-shaped element 3 and can be dispensed with if necessary.

In another embodiment of the invention, the distributor 4 is designed so that there are no grooves 11 in the area identified as 3*a*, or the area 3*a* is created with a predetermined surface roughness, and the grooves 11 and 12 are exclusively formed where the two elements 2 and 3 overlap. Accordingly, all the grooves 11 and/or 12 can be just on the bottom surface of the element 2. In this case, the surface roughness of section 3*a* has the purpose of keeping the exiting liquid active ingredient on the top of the plate-shaped element 3.

As can be seen from the above description, the grooves or channels 11,12 in the overlapping area between the elements 2 and 3 define a tubular connecting system that has the purpose of distributing the liquid active substance that enters from the container 1 into the distributor 4 over the entire length and width of the plate-shaped element 3 in the coinciding area of both elements 2,3. In the embodiment in FIGS. 1–4, the system also evenly distributes the substance outward on the side via the grooves 11 of section 3*a*. This communicating tube system has approximately the effect of a capillary system, i.e., the rinse water arriving at the area 3*a* of the plate-shaped element 3 can draw the liquid active substance from the distributor 4, and this effect can be controlled by the open cross-section of the tube or groove system. The cross section of the tube or groove system hence also depends on the consistency of the liquid active substance and easily allows the life or dispensing time of the active substance to be controlled in relation to the consistency of the liquid active substance.

With the device according to the invention, the container 1 can be exchanged after the active substance is used up, i.e., a new container 1 can be put on by placing it with the opening 7 facing down on the distributor 4. The container 1 is then essentially perpendicular to the plate-shaped elements 2,3.

In another embodiment of the invention, the side of the plate-shaped element 3 facing away from the grooves 12 has a preferably flexible contact section 19 that is shown in FIG. 6 and serves to provide a tight contact with the toilet bowl wall (not shown in FIG. 2). The purpose of section 19 is to specifically guide the water running off of the wall of the toilet bowl to area 3*a* to improve the mixture of the active substance with the rinse water. Section 19 can be flexible so that it adapts to the shape of the wall of the toilet bowl and causes a generally tight seal against the wall of the toilet bowl.

The width of the entire plate-shaped element 3 in FIG. 6 can be as shown in FIG. 3, and the grooves 11 can extend to the edge of section 19, i.e., the grooves 11 can run through sections 19.

In another embodiment of the invention, the distributor 4 consists of the first and second plate-shaped elements 2,3, but the common edge of the two elements is preferably fixed and articulated via a film hinge (not shown).

If one of the two plate-shaped elements 2,3 made of plastic has a flat contact surface in contrast to the other plate-shaped element provided with the ridges 11,12, a certain capillary effect arises in relation to the element with ridges as a result of the preferably central placement of the container neck in reference to the distributor, and this can be used to control the dispensing of the active substance.

The device according to the invention allows the active substance to be guided outward over the plate-shaped element 3 and into the toilet bowl. The active substance is distributed via the grooves 11 in the surface of the element 2. During a flush, the water is guided via the open area, i.e., via section 3*a* and the active substance is washed off. To improve the supply of rinse water to the element 3, the section 19 is bent upward like a lip.

In another preferred embodiment, the ribs 11 are in a V shape and cover a 60° angle while the ribs 12 in the plate-shaped element 3 run in a lengthwise direction and cover and angle of 90°. The ribs 12 are distributed over an area that comprises approximately ⅖ of the entire surface of the element 3.

With the device according to the invention, a continuous dispensing of active ingredient is provided, and the air is effectively freshened. The function of the device according to the invention is based on the interaction between the arising capillary force in the ridges 11,12 and the rinse water of the toilet bowl running off of the area 3*a*. After the container is activated and after repeated flushing, this ensures that the active substance will not run out and be used up even when there is a long time between flushes. The life of the device according to the invention is increased phenomenally, and in particular the life can be controlled individually depending on the utilized active ingredients by correspondingly changing the groove structure. The transfer of the active substance solution in the container 1 is controlled by the capillary force in the container 1 as explained.

What is claimed is:

1. A device to dispense an active substance into rinse water in a toilet bowl, with a container for the active substance, wherein the container has a neck or an opening which is connected with a plate shaped distributor unit, further comprising a device adapted to fix the distributor unit on or close to a wall of the toilet bowl, said distributor unit comprising two plate shaped elements, wherein the plate shaped elements overlap to form a capillary channel between them, and a first group of grooves or channels runs outward from the distributor unit.

2. The device of claim 1, wherein the plate shaped elements extend laterally of the container neck in a first direction, and the first group of grooves or channels run outward in a direction transverse to the lateral direction.

3. A device to dispense an active substance into rinse water in a toilet bowl, with a container for the active substance, wherein the container has a neck or an opening which is connected with a plate shaped distributor unit, further comprising a device adapted to fix the distributor unit on or close to a wall of the toilet bowl, said distributor unit consisting of upper and lower plate shaped elements, wherein the plate shaped elements overlap at a region adjacent the container neck and form a channel at the overlap region which extends away from the container neck, and a lower one of the plate shaped elements extends away from the overlap region to form a projecting area.

4. A device as claimed in claim 3, wherein a first group of grooves is provided on the lower plate shaped element to duct the active substance across the projecting area.

5. A device as claimed in claim 4, wherein an opening is provided in the upper plate shaped element to receive the neck or an opening of the container.

6. A device to dispense a liquid active substance into rinse water in a toilet bowl, with a container for the active substance, wherein the container has a neck or an opening which is connected with a plate shaped distributor unit, further comprising a device adapted to fix the distributor unit on or close to a wall of the toilet bowl, said distributor unit consisting of upper and lower plate shaped elements, said plate shaped elements overlapping at a region, the upper plate shaped element having an aperture therein for cooperating with the container neck or opening to allow liquid from the container to flow between the upper an lower plate shaped elements, and the lower plate shaped element forming a projecting area for liquid to flow onto from between the upper and lower plate shaped elements.

7. A device to dispense an active substance into rinse water in a toilet bowl, with a container for the active substance, wherein the container has a neck or an opening which is connected with a plate shaped distributor unit, further comprising a device adapted to fix the distributor unit on or close to a wall of the toilet bowl, said distributor unit consisting of upper and lower plate shaped elements which overlap to form a channel therebetween, an aperture is provided in the upper plate shaped element, the neck or opening of the container being connected with the aperture for liquid to flow from the container into the channel, and the lower plate shaped element extends away from the overlap region to form an exposed area for liquid to flow into.

8. A device as claimed in claim 7, wherein the exposed area of the lower plate shaped element is provided with grooves or a roughened surface.

9. A device to dispense a liquid active substance into rinse water of a toilet bowl, the device comprising a container for the liquid and a distributor unit, the container having an opening, said distributor unit consisting of upper and lower plates, the plates overlapping at a region to form a channel between them, the upper plate having an aperture in the overlapping region which, in use, is in fluid communication with the container opening for liquid to flow from the container and through the aperture into the channel, the overlapping region extending away from the aperture and the plates being spaced apart for liquid to be distributed along the channel, and the lower plate extending away from the overlapping region to form an exposed region onto which the liquid will flow from the channel and which, in use, is washed by the rinse water.

10. A device to dispense an active substance into rinse water in a toilet bowl, with at least one container for the active substance, wherein each container has a neck or an opening which is connected with a plate shaped distributor unit, further comprising a device adapted to fix the distributor unit on or close to a wall of the toilet bowl, said distributor unit comprising a first and a second plate shaped element, wherein said first and second plate shaped elements overlap to form capillary tubes between them, and a first group of grooves or channels runs outward from the distributor unit.

11. The device of claim 10, wherein the plate shaped elements extend laterally of the container neck in a first direction, and the first group of grooves or channels run outward in a direction transverse to the lateral direction.

12. A device to dispense an active substance into rinse water, in a toilet bowl of a toilet, with at least one container for the active substance, wherein each container has a neck or an opening which is connected with a plate shaped distributor unit, further comprising a device adapted to fix the distributor unit on or close to a wall of a toilet bowl, said distributor unit consisting of upper and lower plate shaped elements, wherein the plate shaped elements neck form a tubular connecting system for the active substance within an overlapping area defined by said plate shaped elements, and one of the plate shaped elements extends away from the overlap region to form a projecting area, whereat said connecting system has the effect of a capillary system.

13. A device as claimed in claim 12, wherein a first group of grooves is provided on the lower plate shaped element to duct the active substance across the projecting area.

14. A device as claimed in claim 12, wherein an opening is provided in the upper plate shaped element to receive the neck or an opening of the container.

15. A device to dispense a liquid active substance into rinse water, in a toilet bowl, with at least one container for the active substance, wherein each container has a neck or an opening which is connected with a plate shaped distributor unit, further comprising a device adapted to fix the distributor unit on or close to the wall of the toilet bowl, said distributor unit consisting of upper and lower plate shaped elements, said plate shaped elements defining an overlapping area, the upper plate shaped element having an aperture therein for co-operating with the container neck or opening to allow liquid from the container to flow between the upper and lower plate shaped elements, and the lower plate shaped element forming a projecting area for liquid to flow onto from between the upper and lower plate shaped elements.

16. A device to dispense an active substance into rinse water adapted for use in a toilet having a toilet bowl, with at least one container for the active substance, wherein the container has a neck or an opening which is connected with a plate shaped distributor unit, further comprising a device adapted to fix the distributor unit on or close to the wall of the toilet bowl, said distributor unit consisting of upper and lower plate shaped elements which overlap to form a communicating tube system therebetween, an aperture is provided in the upper plate shaped element, the neck or opening of the container being connected with the aperture for liquid to flow from the container into the channel, and wherein one of said plate-shaped element has a flat contact surface facing to ridges which are arranged in the opposite plate-shaped element.

* * * * *